US009700187B2

(12) United States Patent
Schultz et al.

(10) Patent No.: US 9,700,187 B2
(45) Date of Patent: Jul. 11, 2017

(54) VACUUM NOZZLE WITH INTEGRATED LIGHT

(71) Applicants: Douglas C. Schultz, Glen Carbon, IL (US); Mark Tomasiak, St. Peters, MO (US); Jason Hill, St. Louis, MO (US)

(72) Inventors: Douglas C. Schultz, Glen Carbon, IL (US); Mark Tomasiak, St. Peters, MO (US); Jason Hill, St. Louis, MO (US)

(73) Assignee: EMERSON ELECTRIC CO., St. Louis, MO (US)

( * ) Notice: Subject to any disclaimer, the term of this patent is extended or adjusted under 35 U.S.C. 154(b) by 441 days.

(21) Appl. No.: 14/452,683

(22) Filed: Aug. 6, 2014

(65) Prior Publication Data

US 2016/0037985 A1 Feb. 11, 2016

(51) Int. Cl.
*A47L 9/30* (2006.01)
*A47L 9/02* (2006.01)

(52) U.S. Cl.
CPC .. *A47L 9/02* (2013.01); *A47L 9/30* (2013.01)

(58) Field of Classification Search
CPC ..... A47L 9/02; A47L 9/30
USPC ..... 15/415.1
IPC ..... A47L 9/30
See application file for complete search history.

(56) References Cited

U.S. PATENT DOCUMENTS

| | | | |
|---|---|---|---|
| 1,521,928 | A | 1/1925 | Campbell |
| 1,942,358 | A | 1/1934 | Grathwol |
| 3,380,103 | A | 4/1968 | Ritzau |
| D215,875 | S | 11/1969 | Hoadley |
| 4,553,284 | A | 11/1985 | Strumbos |
| 4,821,364 | A | 4/1989 | McAllister et al. |
| 4,951,340 | A | 8/1990 | Rietsch |
| 5,046,218 | A | 9/1991 | Cerri |
| 5,123,266 | A | 6/1992 | Tabraham |
| 5,184,372 | A | 2/1993 | Mache |
| 5,189,753 | A | 3/1993 | Sousa |
| 5,454,139 | A | 10/1995 | Beck |
| 5,462,311 | A | 10/1995 | Cipolla |
| 5,485,652 | A | 1/1996 | Holland |
| 5,539,953 | A | 7/1996 | Kurz |
| 5,600,866 | A | 2/1997 | Berfield |
| 5,718,016 | A | 2/1998 | Sung |
| 6,026,541 | A | 2/2000 | Bailey |
| D538,986 | S | 3/2007 | Ingram |
| D540,498 | S | 4/2007 | Tobias |
| 7,293,322 | B2 | 11/2007 | Matousek |
| 7,300,172 | B1 | 11/2007 | Lefler |
| D621,110 | S | 8/2010 | Eden et al. |
| D621,112 | S | 8/2010 | Benacquisto |

(Continued)

FOREIGN PATENT DOCUMENTS

| | | |
|---|---|---|
| EP | 1814430 | 9/2010 |
| WO | 2010/019869 | 2/2010 |

(Continued)

*Primary Examiner* — David Redding
(74) *Attorney, Agent, or Firm* — Sutton McAughan Deaver PLLC

(57) ABSTRACT

A vacuum accessory tool that includes a nozzle body having a first end and a second, spaced apart end and at least one light emitting element that emits light that will illuminate a surface to be cleaned by the accessory tool is described. The light emitting element is protected by a protective housing that protects the element when the tool is inserted into areas during cleaning, yet still allows the light to illuminate surfaces during operation.

19 Claims, 6 Drawing Sheets

(56) References Cited

U.S. PATENT DOCUMENTS

| | | | | |
|---|---|---|---|---|
| D621,565 | S | 8/2010 | Pierce | |
| 8,230,550 | B2 | 7/2012 | Krebs | |
| 8,402,604 | B2 | 3/2013 | Dant | |
| 8,533,907 | B2 | 9/2013 | Eccardt | |
| 2006/0179606 | A1 | 8/2006 | Worwag | |
| 2007/0240275 | A1* | 10/2007 | Willenbring | A47L 9/2805 15/324 |
| 2012/0110770 | A1 | 5/2012 | Hirashima | |
| 2012/0272473 | A1 | 11/2012 | Griffith | |
| 2013/0326843 | A1 | 12/2013 | Schwartz | |
| 2014/0215750 | A1* | 8/2014 | Schultz | A47L 9/0018 15/323 |

FOREIGN PATENT DOCUMENTS

| | | |
|---|---|---|
| WO | 2011092484 | 8/2011 |
| WO | 2013/060880 | 5/2013 |

* cited by examiner

VACUUM NOZZLE WITH INTEGRATED LIGHT

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The inventions disclosed and taught herein relate generally to attachments for vacuum appliances. More specifically, the inventions disclosed and taught herein are related to cleaning tool attachments which are adaptable for use in conjunction with a variety of vacuum cleaners and which include an illuminated portion for use in dark areas during cleaning, such as under seats in an automobile.

Description of the Related Art

Vacuum cleaners of the type having a nozzle end and a handle end, as well as canister-type vacuum appliances like wet/dry vacuum cleaners, are generally well known in the art. When gripped by their handle ends and moved in a generally back and forth oscillatory motion, the nozzle ends of these devices trace a back-and-forth cleaning path. During such typical operation, the wrist of the hand by which the handle ends are gripped controls the trajectory of their nozzle ends. When in normal use with the hand extended straight out, the cleaning path is generally in front of the user, but when the wrists are rolled to either the right or to the left, the cleaning path traced by the nozzle ends follows the roll to the right and left of the wrist. In the case of vacuum appliances such as wet/dry vacuums, the user typically uses a vacuum hose that attaches directly to the vacuum head, allowing for collection of dirt, solid debris, and liquids in the vacuum collection drum. In this operation, the user typically moves the open end of the vacuum hose, versus the entire vacuum appliance, over the debris to be collected.

In general, these vacuum appliances perform quite well to pick up dirt, solid debris, and liquid spillage (in the case of wet/dry vacuums) immediately subjacent to their nozzle ends, whether stationery, or when moved in one of the manners described above. However, to clean areas that lie beyond the cleaning path obtained by manipulating such devices, e.g., within the crevices of wood floors, or under furniture, various attachment tools need to be employed. One type of known attachment tool is the crevice tool. Generally, such a tool includes an end for attachment to the nozzle end of a hand-held vacuum appliance or an associated vacuum hose, a nozzle end, often smaller than the nozzle end of the vacuum cleaner, and a rigid, narrow tube axially connecting the attachment and the nozzle ends in fluid-tight communication.

With the crevice tool attached, back and forth motion of the hand-held vacuum cleaner enables cleaning in small or spatially-confined areas, such as in crevices and cracks (such as the cracks between wood floor boards), as well under furniture where dust, debris, or liquids can accumulate and which do not lie in an area that is easily traced by the standard cleaning path of a vacuum cleaner. For example, U.S. Pat. No. 4,951,340 describes a multi-component crevice tool for a hand-held vacuum cleaner, the nozzle end of which may be indexed to different rotation positions so as to clean spillage in small areas defined by angular cross-sections, such as the small space between a bookshelf and a closely adjacent wall, that otherwise may not permit of ready cleaning (except, for example, by moving the bookcase away from the wall). Other approaches have included crevice tools adapted for use with a water extraction cleaning machine, and tools which incorporate a long, rubber body for flexibility. However, while allowing for access to confined spaces for cleaning, there is no way for the user to see the area being cleaned in order to determine if all the debris has been removed by the vacuuming operation.

Another type of known attachment tool for use with vacuum cleaners for cleaning narrow or hard-to-reach areas is the so-called "extension wand." Generally, such a tool includes an end for attachment to the nozzle end of a hand-held vacuum cleaner, a nozzle end, and an elongated, rigid tube connecting the attachment and nozzle ends in fluid-tight communication. The reach of the vacuum cleaner is thus extended to the degree that the rigid interconnecting tube is elongated, thereby permitting cleaning of spillage and debris in areas that otherwise would lie beyond the reach of the hand-held vacuum cleaner. For example, U.S. Pat. No. 5,462,311 discloses a telescoping assembly especially suited for vacuum cleaner wands that includes a first tube having an outer diameter and a second tube having an inner diameter which is larger than the outer diameter of the first tube. In this way, the first tube fits within the second tube in an axially sliding manner. A collet is positioned within the second tube and encircles the first tube. The collet includes a locking element for selectively securing the first tube in relation to the second tube, the locking element cooperating with a portion of the second tube upon a rotation of the collet to prevent a telescoping movement of the first tube in relation to the second tube. This multi-component extension wand reportedly telescopes outward so as to clean spillage in areas that may lie at different distances.

The previously described and utilized attachment tools, however, have had their utility limited either by over-complexity, difficulty in manufacturing, shortened tool lifespan, or poor air flow design such that during operation, the amount of vacuum pressure available for cleaning is reduced. Additionally, none of these approaches allow for the illumination of dark regions to be cleaned with the attachment nozzle, such as within automobiles, most particularly under the seats and by the operating pedals.

The inventions disclosed and taught herein are directed to vacuum attachments for use with a vacuum appliance, wherein the attachments include a shaped body for enhanced air flow during operation, and a light to allow for the illumination of the regions to be cleaned with simple engagement from the operator.

BRIEF SUMMARY OF THE INVENTION

The objects described above and other advantages and features of the invention are incorporated in the application as set forth herein, and the associated drawings, related to systems for cleaning surfaces, the systems including vacuum accessory tools with at least one light emitting element.

In accordance with a first embodiment of the present disclosure, an attachment tool for a vacuum cleaner operable as a crevice tool is described, the attachment tool comprising an attachment end adapted for mounting to a vacuum cleaner; a nozzle end spaced apart from the attachment end; a nozzle body intermediate between the attachment end and the nozzle end and defining an exterior of the tool, the nozzle body comprising a lower housing region proximate the nozzle and an upper housing region comprising a first, upper body region proximate the air conduit and a second, intermediate body region intermediate the upper housing region and the lower housing region; and a light assembly comprising a housing containing at least one light emitting element that emits light in a UV or visible spectrum and that will illuminate a surface to be cleaned, the light assembly being mounted on a leading, forward end of the nozzle body, wherein the nozzle end is tapered downward and away from the nozzle body. In further aspects of this embodiment, the lower housing region is tapered downward and away from the nozzle body.

In accordance with a further embodiment of the present disclosure, a tool for use with a vacuum accessory is described, the tool comprising a main body having a first end including a suction inlet, a second end including a discharge outlet, and an internal air path; a receiving region on a top face of the main body sized to receive an illumination assembly; and an illumination assembly, the illumination assembly including a cover and a light emitting element, wherein the suction inlet is in fluid communication with the discharge outlet and the tool includes a longitudinal centerline axis A.

In yet another embodiment of the present disclosure, a vacuum cleaner system is described, the vacuum system comprising a housing; a debris collection vessel; a vacuum suction generator; a cleaning hose connected to the suction generator; and a crevice tool including: a main body having a first end including a suction inlet, a second end including a discharge outlet, an internal air path, and a longitudinal centerline axis A; a nozzle body intermediate between the suction inlet and the discharge outlet, the nozzle body comprising a lower housing region proximate the suction inlet and an upper housing region comprising a first, upper body region proximate the discharge outlet and a second, intermediate body region intermediate the upper housing region and the lower housing region; and a light assembly comprising a light housing containing at least one light emitting element that will illuminate a surface to be cleaned, the light assembly being mounted on a leading, forward end of the intermediate body region, wherein the lower housing region is tapered downward and away from the nozzle body.

BRIEF DESCRIPTION OF THE SEVERAL VIEWS OF THE DRAWINGS

The following figures form part of the present specification and are included to further demonstrate certain aspects of the present invention. The invention may be better understood by reference to one or more of these figures in combination with the detailed description of specific embodiments presented herein.

Figure 1:
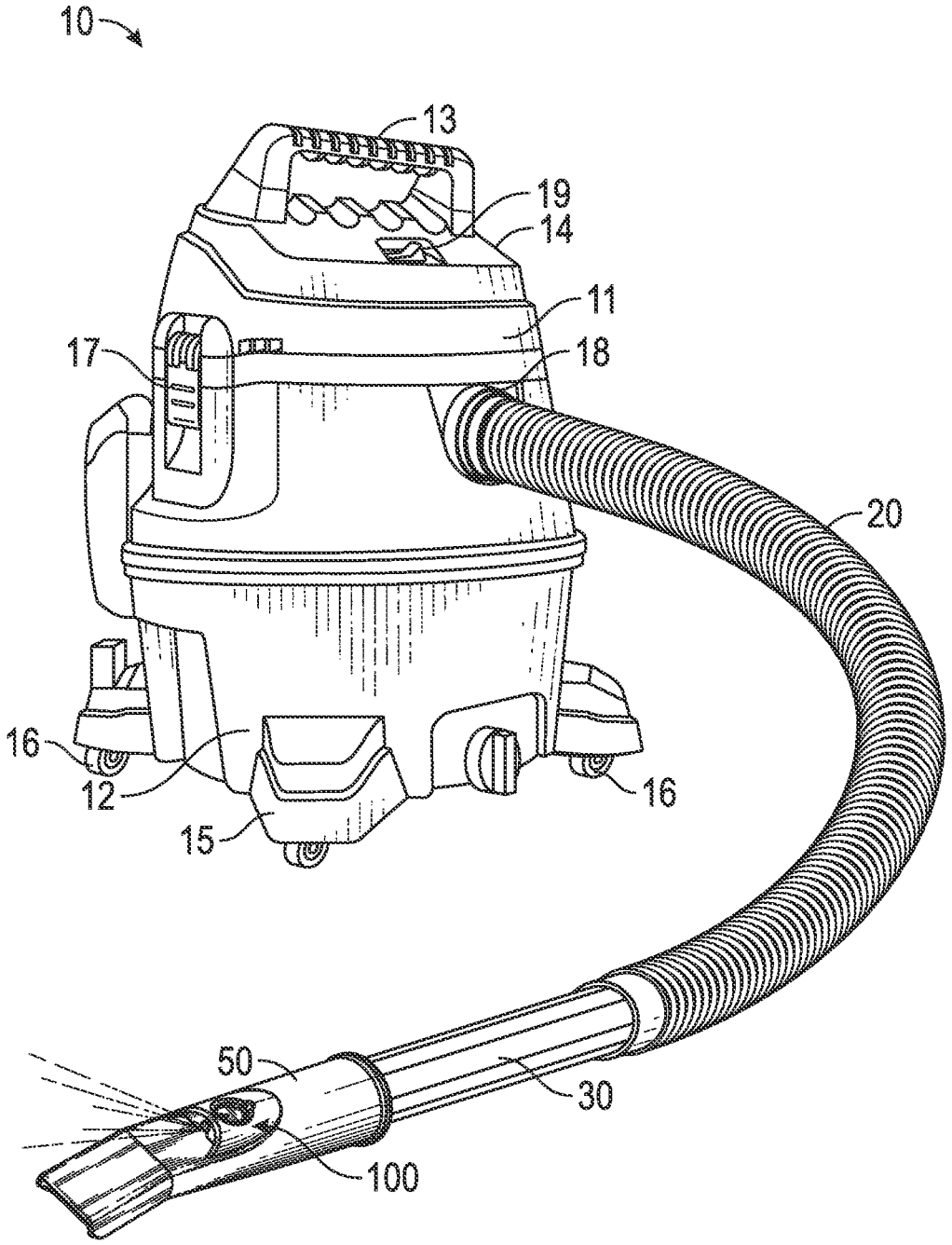
FIG. 1 illustrates a perspective view of an exemplary vacuum appliance incorporating a vacuum nozzle attachment tool in accordance with the present disclosure.

While the inventions disclosed herein are susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DETAILED DESCRIPTION

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

Applicants have created a vacuum accessory tool, specifically a vacuum nozzle, such as the type used for cleaning surfaces within automobiles, wherein the tool includes a nozzle body having a suction nozzle at one end formed by the body, and an attachment end for fluidic attachment to a remote vacuum source, such as a vacuum cleaner. The body of the tool also includes at least one light emitting element that emits light on a surface to be vacuumed.

Turning now to the figures, FIG. 1 illustrates a perspective view of an exemplary vacuum appliance 10 with a collection drum incorporating a vacuum nozzle accessory tool 50, in accordance with the present disclosure. The vacuum nozzle tool 50 may be coupled directly to a suction means such as flexible vacuum hose 20 attached to a vacuum inlet of a vacuum appliance, such as a wet/dry vacuum 10, or to an optional hose extension wand 30 which can be inserted intermediate between a vacuum hose 20 and the tool 50, via any appropriate coupling method, such as by frictional attachment, threaded attachment, or similar, locking attachment methods. While the figure illustrates a wet/dry vacuum appliance 10, it will be realized that the vacuum nozzle 50 as described herein may be used in association with any of a number of types of vacuum appliances, including but not limited to upright vacuum cleaners, backpack vacuum cleaners, hand-held vacuum cleaners, wall-mounted vacuum cleaners, canister-type vacuum cleaners, and central-vacuum systems.

As shown in FIG. 1, there is illustrated in perspective view an exemplary vacuum appliance 10 suitable for use with the accessory tool 50 described herein. In one preferred embodiment of the instant disclosure, vacuum 10 is of the wet/dry variety, i.e., capable of picking up both wet and dry material. Vacuum 10 comprises a collection canister, or drum, 12 having a bottom, sides, an open top opposite the bottom, a lid 11, and a powerhead 14 attached to the top face of lid 11, which is releasably secured over the open top of collection canister 12 via handles 17. Affixed to the bottom of drum 12 are a plurality of casters 15 having wheels 16 which allow the vacuum 10 to be pushed or pulled, the casters 15 being optionally shaped to have stepped mounting means formed on their top face for accepting vacuum accessories such as vacuum wands and the like for storage when the accessories are not in use. Collection drum 12 may also include a drain outlet and drain plug member 13 at the bottom of the drum, so as to allow for enhanced removal of liquid debris from within the drum itself, such as with a pump accessory as shown in U.S. Design Pat. No. D551, 681. Powerhead 14 houses a motor and impeller assembly (not shown) within an impeller chamber, for establishing vacuum pressure within the vacuum 10 during operation. A flexible vacuum hose 20 is configured so that one end can be inserted into an air inlet 18 formed in the front portion of the powerhead 14. In one embodiment, hose 20 is simply friction-fitted into inlet port 18. In other embodiments of the present disclosure, hose 20 may be lock-fit into inlet port 18, or employ a quick-connect/disconnect mechanism in order to obtain a leak-free seal, in accordance with U.S. Pat. Nos. 6,370,730 and 6,115,881, both of which are incorporated herein by reference. The collection drum, the lid and the powerhead of vacuum 10 are preferably made of injection-molded plastic, such as polypropylene or the like, in accordance with conventional practice.

In accordance with conventional designs, the air inlet port 18 is defined in a side wall of the collection drum 12 as shown, or alternatively, may be defined in the lid or within a face of powerhead 14. The powerhead assembly 14 houses a motor and an impeller assembly housed within an impeller chamber, and has defined therein an air exhaust or outlet port (not shown). The powerhead assembly 14 is operable to create a suction within the collection drum 12, such that during operation debris and/or liquid is drawn into the collection drum 12 through the hose 20, which is attached to the inlet port 18 via an appropriate connection member that may be locking or not.

From FIG. 1 it is apparent that an upper portion of the powerhead may be configured to serve as a carrying handle for vacuum 10. Toward the front of handle 13, an on/off switch 19 may be disposed, such that the switch may be conveniently reached with one's thumb while holding vacuum 10 by the handle. Power to the vacuum appliance 10 may be via a typical AC power source via power cord, or via a so battery system, as appropriate.

Figure 2:
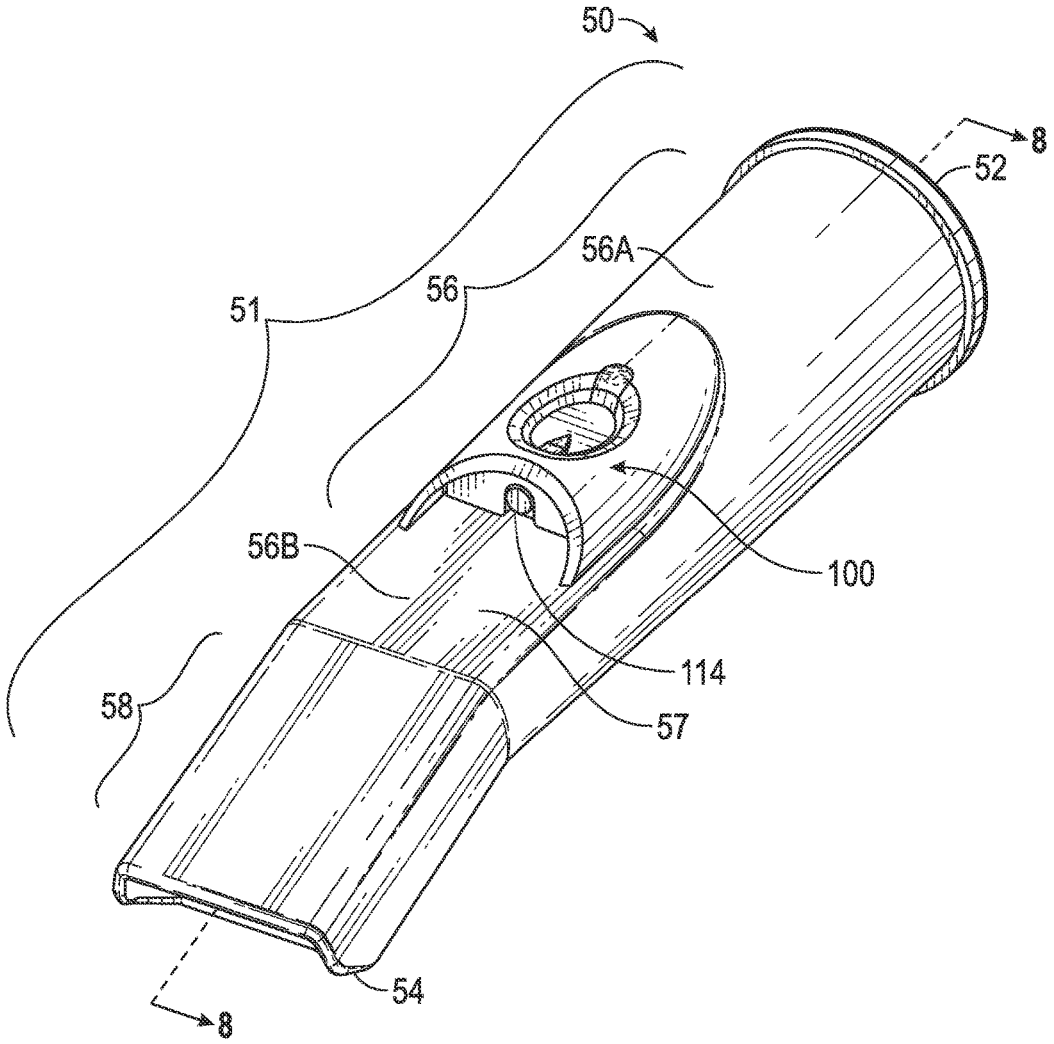
FIG. 2 illustrates a perspective view of an exemplary attachment tool in accordance with the present disclosure.
Figure 3:
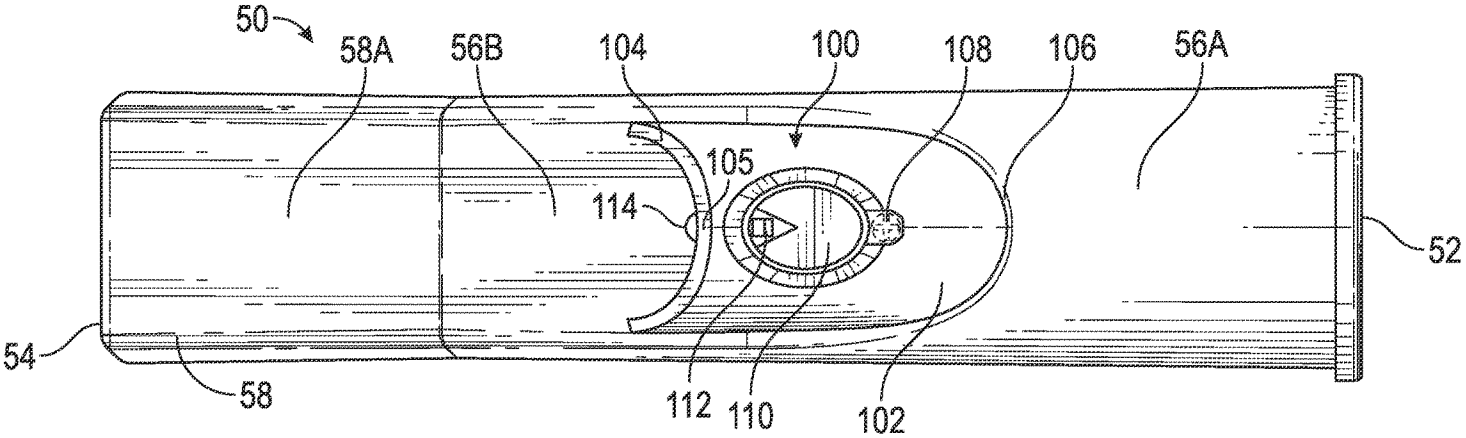
FIG. 3 illustrates a top view of the attachment tool of FIG. 2.
Figure 4:
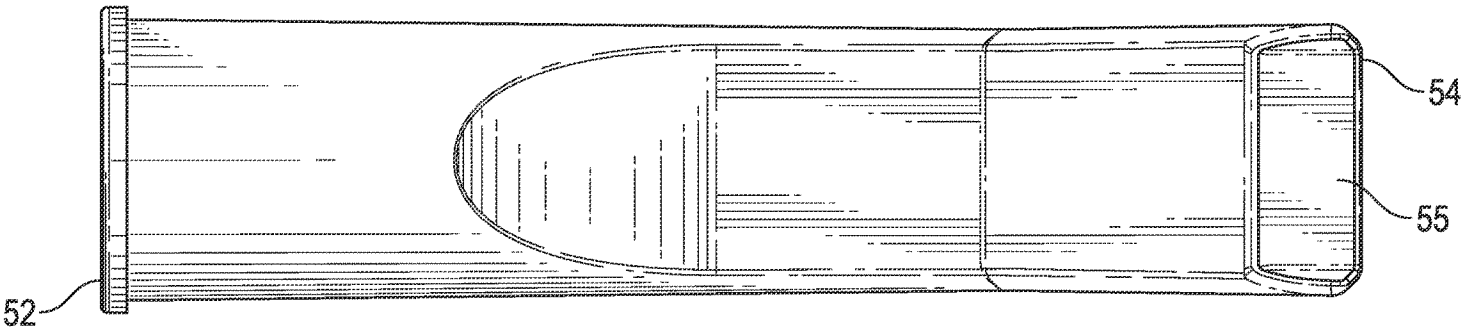
FIG. 4 illustrates a bottom view of the attachment tool of FIG. 2.
Figure 5:
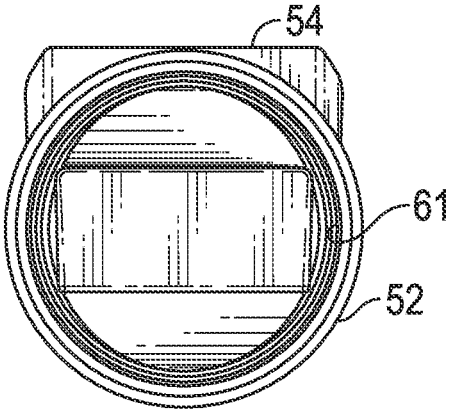
FIG. 5 illustrates a rear view of the attachment tool of FIG. 2.
Figure 6:
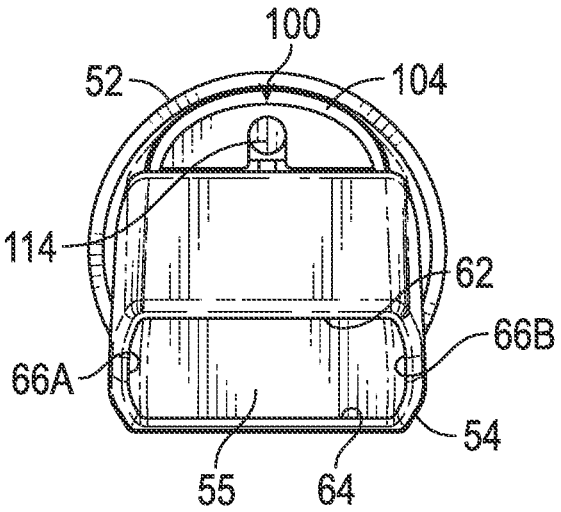
FIG. 6 illustrates a front view of the attachment tool of FIG. 2.

The details of an exemplary vacuum nozzle 50 in accordance with the present disclosure are illustrated in FIGS. 2-8. FIG. 2 is a perspective view of an exemplary vacuum nozzle 50. FIG. 3 is a top view of the exemplary nozzle 50; FIG. 4 is a bottom view of nozzle 50. FIG. 5 is a front end view of the exemplary vacuum nozzle 50, and FIG. 6 is a rear, or back end view of the exemplary vacuum nozzle 50. These Figures will be discussed in combination.

As best shown in the perspective view of FIG. 2, vacuum nozzle accessory tool 50 according to a first embodiment of the invention comprises a nozzle body 51 formed by the an upper housing region 56 and a lower housing region 58, forming an attachment end and a spaced apart nozzle end, respectively. The tool 10 further comprises an illumination, or light emitting element 114 and associated light assembly 100 attached to a top face 57 of the upper housing. The tool 50, in whole or in parts thereof, such as at least the nozzle body 51, is preferably formed of a plastic or other polymeric material by any appropriate method, such as by blow molding, rotomolding, or similar production methods.

In the illustrated embodiment, a suction nozzle 54 is formed at a forward, lower portion of the lower housing 58. The upper housing 56 further includes a working air conduit 52 positioned on an end of the nozzle body 51 opposite the suction nozzle 54, the upper housing further comprising a first, upper body region 56A, proximate the air conduit 52, and a second, intermediate body region 56B intermediate the upper body region 56A and the lower housing region 58. As shown in the figures, intermediate body region 56B may further and optionally be shaped, such as in a substantially planar manner to form a flat, planar region 57 on the top surface of region 56B, so as to receive at least a part of a similarly-shaped illumination assembly 100. The working air conduit 52 is configured to be connected to a vacuum hose 20 (or similar vacuum connection assembly, such as a vacuum wand 30) to couple the tool 50 to a remote suction source 10, such as a wet/dry vacuum appliance.

Light assembly 100 includes a light housing or cover 102 containing a power source (such as a battery, not shown) and the light emitting element(s) 114, the cover 102 having a forward, frontal edge 104 and a rearward edge 106, the rearward edge sized and shaped to mate with upper body region 56A. As shown in the Figures, cover 102 may be of an inverted "U-shape", although it is not limited to this configuration, and any other appropriate shape may be used as desired. The top face, or surface of the light housing, or cover 102 further includes at least one attachment element 108, such as a screw or similar threaded attachment element, or similar attachment means. Also located on the top face or surface of the cover 102 is at least one power switch, or actuator, 110. In the embodiment shown in the figures, and as particularly shown in FIG. 3, the accessory tool 50 can include a primary power switch 110, and a secondary power switch 112. During operation, the user depresses the primary power switch 110 to turn the light emitting element 114 "on" or "off", the switch being actuated by either depressing and releasing it, or depressing it and keeping it depressed during operation to keep the light element 114 illuminated. Alternatively, a user can depress the secondary power switch 112 so as to toggle the light between a "constant on" operation mode and a "intermittent" mode, or an "off" and "on" mode, the latter of these working, for example, when the switch 112 is toggled and held in one direction or another by the user, as the user deems appropriate for the particular task for which the tool 50 is being used. Other power actuation modes and variations will be understood by those of skill in the art.

The air and debris suction chamber 60 within nozzle tool 50 is defined by the interior regions of the various body regions, which typically include top walls, bottom walls, and side walls, as appropriate, and depending upon the shape of the particular body region. For example, in upper body region 56A, as illustrated, there is a single wall 61 rather than separate top, bottom, and side walls. However, as illustrated in the frontal view of FIG. 6, the chamber 60 is defined by interior top wall 62, opposite, interior bottom wall 64, and opposite interior side walls 66A, 66B, the side walls being generally perpendicular to the top and bottom walls. The walls 62, 64, 66 at the terminal end of the lower housing region 58 of the suction chamber define an open mouth 55.

FIG. 5 and FIG. 6 illustrate rear and front views of accessory nozzle tool 50, respectively. As shown in the exemplary figures, the first end, suction nozzle 54, has a substantially oval-shaped cross section, while the second end of the main body 51, working air conduit 52, has a generally circular cross section. The oval cross-section tapers upward toward a more circular cross section moving from the first end of the tool to the second end, as shown perhaps most clearly in FIG. 6.

Figure 7:
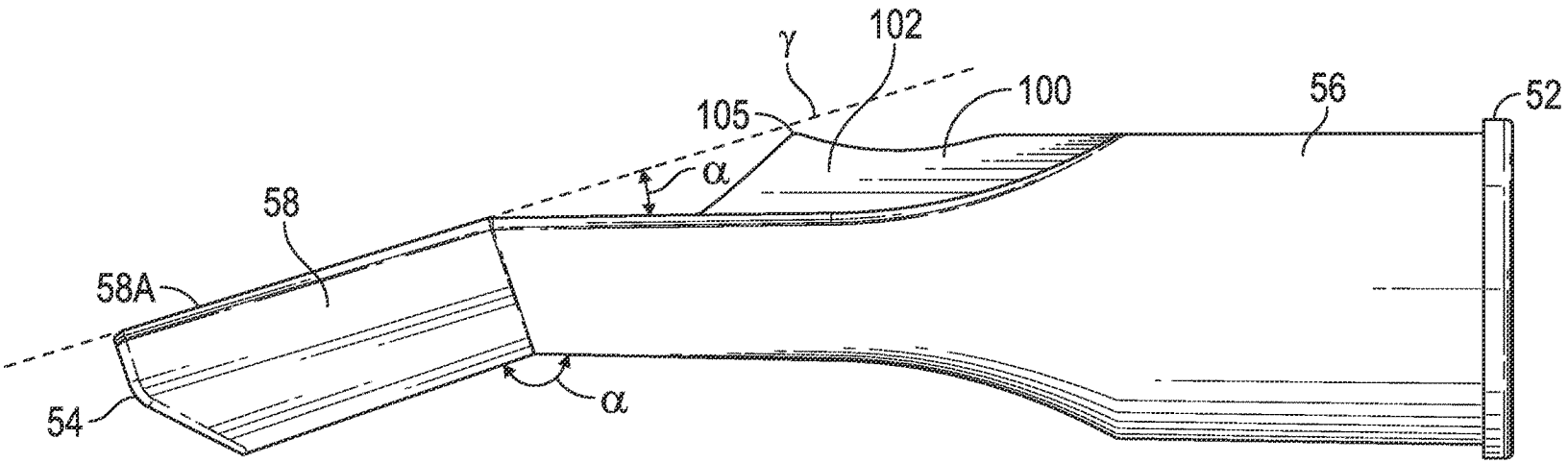
FIG. 7 illustrates a side view of the attachment tool of FIG. 2.
Figure 8:
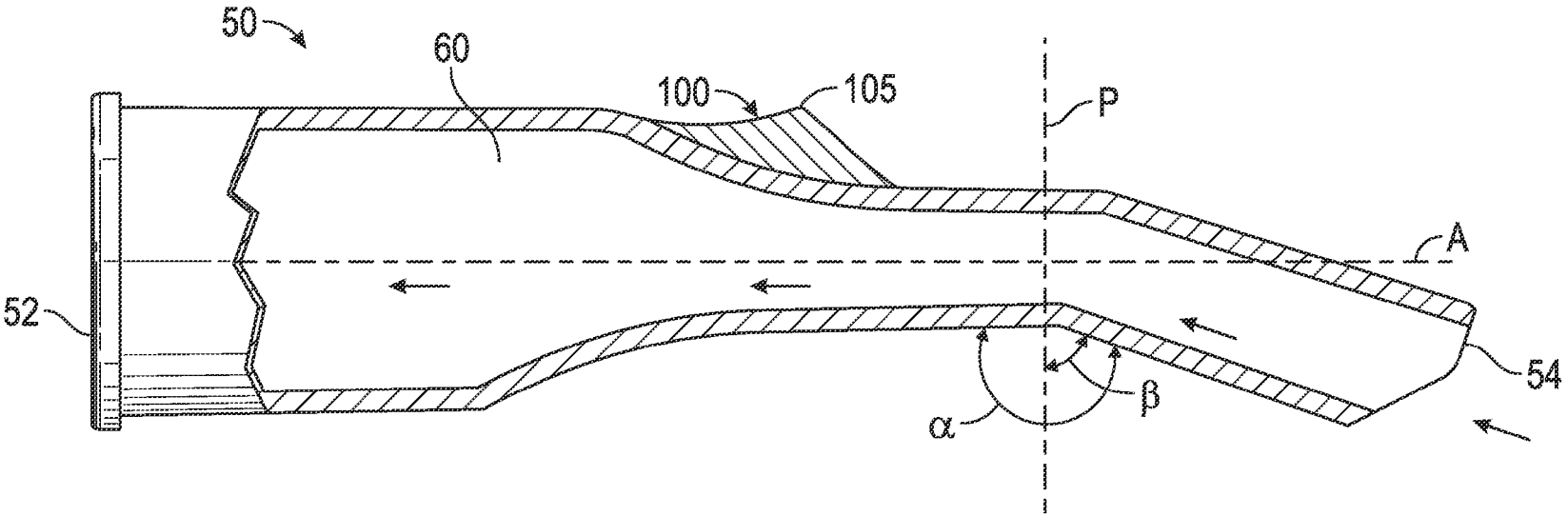
FIG. 8 illustrates a partial cross-sectional view of the attachment tool of FIG. 2, taken along line A-A.

FIG. 7 and FIG. 8 illustrate in more detail the tapered and downward angle orientation of the lower housing 58 relative to the upper housing 56. These figures also illustrate the relationship between the orientation, or downward deflection angle, of the lower housing 58 to the forward, front edge 104 of the of the light assembly 100, which advantageously allows for a deep penetration of the nozzle assembly 50 into an orifice, such as between a seat in an automobile, while simultaneously allowing for illumination of the surface to be cleaned with the light assembly and light emitting element 114 without damaging or blocking the light assembly 100. That is, the relationship between the angle of downward deflection of the lower housing 58 and the placement of the light assembly 100 on the upper housing 56 is such that illumination is not compromised, and the light emitting element 114 is protected from damage. FIG. 7 illustrates this relationship, in accordance with embodiments of this disclosure.

More particularly, as illustrated in the side view of FIG. 7, a plane $\gamma$ that is in alignment with and parallel to the top face 58A of lower housing region 58, when extended upward in the direction of the upper housing 56, intersects the front, or forward edge 104 of the light cover 102. In accordance with select aspects of this embodiment of the present disclosure, plane $\gamma$ intersects the light cover 102 at the highest, most forward and central point 105. As also illustrated generally in FIG. 7, the plane $\gamma$ forms an angle $\delta$ between the top face 57 of upper body region 56B and the plane $\gamma$, the angle $\delta$ ranging from about 20° to about 40°, preferably about 30°.

FIG. 8 illustrates a cross-sectional view of the tool 50 of FIG. 2, taken along line 8-8. The tool of the present disclosure includes a central, longitudinal axis A. The arrows (→) indicate direction of air flow through the internal air path 60 of the nozzle in tool 50, from a surface being cleaned (not shown), in through the suction inlet region 55 of the suction nozzle 54, though the interior suction chamber 60, and out the air conduit 52 and toward a vacuum appliance 10 that is in operation with the vacuum nozzle tool. An axis drawn perpendicular, or normal, to the longitudinal axis A, perpendicular axis P, allows for a relationship between the upper housing region 56 of the tool 50, and the lower housing region 58 to be described. That is, the lower housing region 58 is disposed at a downward, deflective angle relative to the longitudinal axis A along which upper housing region 56 is aligned. The angle of downward deflection can be described as an obtuse angle $\alpha$ relative to the longitudinal axis A, or as an acute angle $\beta$ relative to the perpendicular axis P. More particularly, lower housing region 58 can be oriented in a downward direction away from the upper housing region 56 at an obtuse angle $\alpha$ relative to the longitudinal axis A, the angle $\alpha$ ranging from about 100° to about 170°, more particularly from about 110° to about 165°, and more particularly from about 120° to about 160°, including an angle of about 130°, about 140°, and about 150°. This relationship is also shown schematically in the side view of FIG. 7, similarly illustrating the angle of downward offset $\alpha$. Alternatively, and equally acceptable, the lower housing region 58 can be oriented in a downward direction away from the upper housing region 56 at an acute angle $\beta$ relative to the perpendicular axis P, the angle $\beta$ ranging from about 30° to about 80°, more particularly from about 30° to about 75°, and more particularly from about 40° to about 70°, including an angle of about 45°, about 50°, about 55°, about 60°, and about 65°.

Details of the light assembly 100 attached to tool 50 are perhaps best seen with reference to FIG. 3. The illumination, or light emitting element 114 is preferably positioned on or towards a leading edge of the tool 50, so as to effectively illuminate the surfaces to be cleaned. The light assembly 100 comprises at least one light emitting element 114, a housing or cover 102, and a power source, such as a battery (not shown). The light emitting element 114 can be chosen from a range of optional light emitting elements based upon the desired effect and dictated by the range in the light spectrum. For example, illumination of the surface to be cleaned requires a light source in the visible light spectrum with a wavelength of at least 400 nanometers (nm). Other options include various ranges in the ultraviolet (UV) light spectrum. For example, light in the UVA range comprising a wavelength from about 400 nanometers to about 320 nanometers (also known as "black light") is effective for illuminating carbon-based stains, including pet stains such as urine stains. UVA light causes carbon-based stains to fluoresce, thus making the previously invisible stain visible to the eye. Furthermore, it is known that illuminating certain peroxygen cleaning compounds with UVA light can improve cleaning efficacy and decrease the cleaning time. In accordance with aspects of the present disclosure, the light emitting element 114 can also optionally be chosen to have a sanitization or disinfection action on the surface to be cleaned. Disinfecting the surface to be cleaned is best achieved with a UVC wavelength of about 260 nanometers; however wavelengths from about 280 nm to about 100 nm are also effective. Once the desired effect is known, the light emitting element 114 can be chosen from known constructions, including light emitting diodes (LED), incandescent, fluorescent, and combinations thereof. Furthermore, multiple dissimilar light emitting element types can be incorporated into the illumination light assembly 100, without limitation. Use of a commonly known selector or toggle switch, such as toggle switch 112, can allow selection of UVA, UVC, and/or visible light independently, or, in various combinations depending on the specific desired use.

Referring to FIGS. 2 and 3, at least one mounting recess can optionally be formed on a leading surface of the intermediate body region 56B on which the light assembly 100, which includes light emitting element 114, may be positioned. A cover 102 is mounted on the intermediate body region 56B to enclose the mounting recesses and can further optionally include at least one lens (not shown) at the forward region, proximate to forward edge 104, to allow light from the light emitting element 114 to pass through the lens. The lens can be transparent or translucent and can advantageously be convex-shaped to disperse the light emitted by the light emitting element 114. Alternately, the cover 102 can be made from a transparent or translucent material thereby transmitting light from the light emitting element 114 through at least a part of the cover in addition to, or without need for, an optional lens. The cover 102 can also include integral mounting features (not shown) to house and retain the light emitting element 114.

In accordance with alternative embodiments of the present disclosure, the vacuum nozzle accessory tool 50 can further comprises an external power source for supplying power to the Illumination assembly 100. In one exemplary, preferred embodiment, the external power source can be the vacuum appliance itself, supplying power though a cord or similar power conveying means or system to power the illumination assembly 100 while the vacuum appliance is in operation.

Other and further embodiments utilizing one or more aspects of the inventions described above can be devised without departing from the spirit of Applicant's invention. For example, the Illumination device can be arranged so as to circumscribe one or more portions of the vacuum nozzle or tool, e.g., the lights can circumscribe the body of the vacuum tool. Further, the various methods and embodiments of the methods of manufacture and assembly of the system, as well as location specifications, can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. An attachment tool for a vacuum cleaner operable as a crevice tool, the attachment tool comprising:

an attachment end adapted for mounting to a vacuum cleaner;

a nozzle end spaced apart from the attachment end;

a nozzle body intermediate between the attachment end and the nozzle end and defining an exterior of the tool, the nozzle body comprising a lower housing region proximate the nozzle and an upper housing region comprising a first, upper body region proximate the air conduit and a second, intermediate body region intermediate the upper housing region and the lower housing region; and a light assembly comprising a housing containing at least one light emitting element that emits light in a UV or visible spectrum and that will illuminate a surface to be cleaned, the light assembly being mounted on a leading, forward end of the nozzle body, wherein the nozzle end is tapered downward and away from the nozzle body, and wherein the housing of the light assembly has a forward edge, and wherein a plane extending parallel to the nozzle end intersects the forward edge.

2. The attachment tool of claim 1, wherein the lower housing region is tapered downward and away from the nozzle body.

3. The attachment tool of claim 2, wherein the lower housing region is tapered at an angle ranging from about 130° to about 170° relative to a horizontal axis of the attachment tool.

4. The attachment tool of claim 1, wherein the at least one light emitting element is at least one light emitting diode (LED).

5. The attachment tool of claim 1, wherein the at least one light emitting element further comprises a convex lens to disperse light illuminated from the at least one light emitting element.

6. The attachment tool of claim 1, further comprising a power switch mounted within the light assembly for powering the at least one light emitting element.

7. The attachment tool of claim 1, wherein the housing of the light assembly has a U-shape.

8. The attachment tool of claim 1, wherein the first upper body region has a circular cross section.

9. The attachment tool of claim 1, wherein the lower housing region has an oval cross section.

10. The attachment tool of claim 1, wherein the nozzle body is formed of a plastic material by blow molding.

11. A tool, comprising:

a main body having a first end including a suction inlet, a second end including a discharge outlet, and an internal air path;

a receiving region on a top face of the main body sized to receive an illumination assembly; and an illumination assembly, the illumination assembly including a cover and a light emitting element, wherein the suction inlet is in fluid communication with the discharge outlet and the tool includes a longitudinal centerline axis A, and wherein the cover of the illumination assembly has a forward edge, and wherein a plane extending parallel to the suction inlet intersects the forward edge.

12. The tool of claim 11, wherein the first end of the main body is tapered toward the first suction inlet and the taper is offset from the longitudinal centerline axis A.

13. The tool of claim 12, wherein the offset taper is offset at an angle ranging from about 110° to about 165° relative to the longitudinal centerline axis A.

14. The tool of claim 11, wherein the second end of the main body has a circular cross section.

15. The tool of claim 11, wherein the plane intersects the forward edge at an angle relative to a body portion intermediate between the first end and the second end at an angle between about 20° and about 40°.

16. A vacuum cleaner system comprising:

a housing;

a debris collection vessel;

a vacuum suction generator;

a cleaning hose connected to the suction generator; and a crevice tool including:

a main body having a first end including a suction inlet, a second end including a discharge outlet, an internal air path, and a longitudinal centerline axis A;

a nozzle body intermediate between the suction inlet and the discharge outlet, the nozzle body comprising a lower housing region proximate the suction inlet and an upper housing region comprising a first, upper body region proximate the discharge outlet and a second, intermediate body region intermediate the upper housing region and the lower housing region; and a light assembly comprising a light housing containing at least one light emitting element that will illuminate a surface to be cleaned, the light assembly being mounted on a leading, forward end of the intermediate body region, wherein the lower housing region is tapered downward and away from the nozzle body, and wherein the housing of the light assembly has a forward edge, and wherein a plane extending parallel to the suction inlet intersects the forward edge.

17. The system of claim 16, wherein the lower housing region is tapered downward at an angle ranging from about 110° to about 165° relative to the longitudinal centerline axis A.

18. The system of claim 17, wherein the angle ranges from about 130° to about 160° relative to the longitudinal centerline axis A.

19. The system of claim 16, wherein the discharge outlet has a circular cross section.

* * * * *